US007050073B2

(12) United States Patent
Abler

(10) Patent No.: US 7,050,073 B2
(45) Date of Patent: May 23, 2006

(54) METHOD AND APPARATUS FOR SCROLLING AN IMAGE TO BE PRESENTED ON A DISPLAY UNIT

(75) Inventor: Michael Abler, München (DE)

(73) Assignee: Infineon Technologies AG., Munich (DE)

( * ) Notice: Subject to any disclaimer, the term of this patent is extended or adjusted under 35 U.S.C. 154(b) by 555 days.

(21) Appl. No.: 10/003,552

(22) Filed: Oct. 24, 2001

(65) Prior Publication Data

US 2002/0105525 A1 Aug. 8, 2002

(30) Foreign Application Priority Data

Oct. 24, 2000 (DE) ..... 100 52 695

(51) Int. Cl.
*G09G 5/34* (2006.01)

(52) U.S. Cl. ..... 345/684; 346/685

(58) Field of Classification Search ..... 345/684, 345/685, 686, 687, 688, 784, 785, 786, 787, 345/830

See application file for complete search history.

(56) References Cited

U.S. PATENT DOCUMENTS

| | | | | |
|---|---|---|---|---|
| 4,602,251 A | | 7/1986 | Sawada et al. | |
| 4,845,631 A | | 7/1989 | Bottorf | |
| 5,208,588 A | | 5/1993 | Nishiyama | |
| 5,396,430 A | * | 3/1995 | Arakawa et al. | 701/200 |
| 5,754,161 A | * | 5/1998 | Noguchi et al. | 345/684 |
| 5,798,749 A | * | 8/1998 | Minematsu et al. | 345/785 |

* cited by examiner

*Primary Examiner*—Matthew Luu
*Assistant Examiner*—Daniel Chung
(74) *Attorney, Agent, or Firm*—Marshall, Gerstein & Borun LLP

(57) ABSTRACT

In order to enable the gentlest possible scrolling of an image to be presented on a display unit, without restricting the scrolling range and with a low outlay, an image area is defined that is larger than the image area that can be presented on the display unit. This larger image area is subdivided into a number of image area sections to which the image data of a corresponding memory section of a frame buffer provided for storing the image data of the image area are assigned by means of corresponding address information items.

18 Claims, 8 Drawing Sheets

METHOD AND APPARATUS FOR SCROLLING AN IMAGE TO BE PRESENTED ON A DISPLAY UNIT

FIELD OF INVENTION

The present invention relates to a method and apparatus for scrolling an image to be presented on a display unit, such as the monitor of a computer or a screen, for example.

BACKGROUND OF INVENTION

In order to present images on a display unit of this type, it is conventional practice to read image data from a suitable storage medium, for example a CD-ROM, a hard disk, a server or the like and to store them in a buffer memory. A graphics accelerator accesses the image data stored in the buffer memory and moves them to a frame buffer. A display refresh unit ("Screen Refresh Unit") accesses the image data stored in the frame buffer in order correspondingly continually to refresh the content of the display unit.

Graphics cards of the kind used for computer applications, for example, realize the scrolling of the image content presented on the display unit by using a high-performance graphics accelerator which accesses the frame buffer with a high bandwidth. The scrolling is carried out pixel by pixel. By way of example, if the image presented on the display unit is scrolled in the horizontal direction, the entire image content presented on the display unit is scrolled pixel by pixel in the horizontal direction. The consequence of this is that, at the left-hand edge of the display unit, a pixel column has to be filled with new image data which are read from a suitable storage medium, for example a CD-ROM. If the display unit is, for example, a screen with 1024×768 pixels, the content of the frame buffer has to be refreshed 1024 times for the scrolling of a complete screen content. Assuming that the scrolling is to be concluded within a time period of is and the graphics card operates in the 256 color mode (i.e., each pixel is represented by one byte), the graphics accelerator requires the following theoretical bandwidth:

$$1[\text{byte/pixel}]\times 1024\times 768[\text{pixels}]\times 1024[1/\text{s}]=0.805\ \text{GB/s} \quad (1)$$

In computer applications, the corresponding monitor carries out temporal subsampling in the range typically of 50 Hz–120 Hz of the image output by the graphics card. This reduces the bandwidth required in practice compared with the theoretical bandwidth to a minimum of 39.1 MB/s (=1[byte/pixel]×1024×768[pixels]×50[1/s]) for subsampling at 50 Hz and a maximum of 94.3 MB/s (=1[byte/pixel]×1024×768[pixels]×120[1/s] for subsampling at 120 Hz.

The advantage of this solution is that the scrolling range is not restricted to the width of the frame buffer. On the other hand, the disadvantage is that a high-performance graphics accelerator with a very high bandwidth is required.

For navigation systems of the kind used in motor vehicles, a graphics accelerator with a high bandwidth has likewise been required hitherto in order to be able to scroll the representation of a map gently across a corresponding display unit. In order to obviate a graphics accelerator with such a high bandwith, a solution has been proposed for this area of application in which no memory transfers are necessary and, consequently, the overall system costs, the electromagnetic emission and the power consumption are reduced. In accordance with this solution, an image area, also referred to as a "scroll layer" or "map layer", is defined, the dimensions of which in the horizontal and vertical direction are larger than the visible image area of the display unit. The position of the visible image area of the display unit within this larger image area is defined with the aid of a so-called pointer, the pointer designating for example the (xy) position of the top left corner of the visible image area of the display unit within the said larger image area. Consequently, the image that can be presented on the display unit can be scrolled in the horizontal and vertical direction simply by changing the pointer, without memory transfers being necessary for this purpose. Whereas the scrolling is carried out in particular by the graphics accelerator in the case of the above-described first solution for computer applications, the scrolling is carried out by the display refresh unit ("screen refresh unit") in the case of this second-mentioned solution. However, the disadvantage of this second-mentioned solution is that the scrolling range is restricted by the width of the frame buffer.

SUMMARY OF THE INVENTION

The present disclosure proposes a method and apparatus for scrolling an image to be presented on a display unit wherein the above-described problems are eliminated and, in particular, a graphics accelerator with a high bandwidth is not required and the scrolling range is not restricted by the width of the frame buffer.

According to the teachings of the present invention, a method for scrolling an image to be presented on a display unit is disclosed. A first step comprises storing image data of a first image area and a frame buffer, wherein the first image area is larger than a second image area that can be presented on the display unit and contains the second image area. Next, the frame buffer is addressed in a manner dependent on first address information items that define the position of the second image area within the first image area. Corresponding image data from the frame buffer is read and presented on the display unit in the form of the second image area. The first address information items are changed then in order to scroll the second image area presented on the display unit. The first image area is subdivided into a plurality of image area sections in the image data is assigned a corresponding memory section of the frame buffer to each image area section through the use of corresponding second address information items. A boundary is defined for the position of the second image area within the first image area by utilizing the first address information items. Next, the position of the second image area is monitored within the first image area with respect to the boundary and new image data is loaded into specific memory sections of the frame buffer that are assigned to the image area sections of the first image area that are the furthest away from a specific boundary location in a direction opposite to a scrolling direction when the boundary is reached at the specific boundary location on account of scrolling of the second image area. The second address information items are correspondingly changed in such a way that the first image area is extended in the scrolling direction by the image area sections which are furthest away from the specific boundary location in the direction opposite to the scrolling direction and for which new image data have been loaded into the specific memory sections.

According to the disclosed apparatus constructed in accordance with the teachings of the present invention, the apparatus is used for scrolling an image to be presented on a display unit and comprises a frame buffer configured for storing image data of a first image area, wherein the first image area is larger than the second image area that can be presented on the display unit and contains the second image area. The apparatus further includes a memory configured for storing first address information items, which define the position of the second image area within the first image area. Additionally, a control system is included that is configured for addressing the frame buffer in a manner dependent on the first address information items and for reading corresponding image data from the frame buffer in order to present the image data on the display unit in the form of the second image area, wherein the second image area to be presented on the display unit can be scrolled by changing the first address information items. The first image area is subdivided into a plurality of image area sections in the image data of a corresponding memory section of the frame buffer are assigned to each image area section by using corresponding second address information items, which are stored in the memory. A boundary is defined for the position of the second image area within the first image area by utilizing the first address information items. The control system is further configured to monitor the position of the second image area within the first image area with respect to the boundary and, in a case when the boundary is reached at a specific boundary location on account of scrolling of the second image area, the control system causes memory sections of the frame buffer, which are assigned to the image area sections of the first image area that are furthest away from the specific boundary location in a direction opposite to a scrolling direction, to be loaded with new image data. Also, the second address information items stored in the memory are changed such that the first image area is extended in the scrolling direction by the image area sections that are the furthest away from the specific boundary location in the opposite direction of the scrolling direction and for which new image data have been loaded into the corresponding memory sections of the frame buffer.

The disclosed method and apparatus offers the advantages of the two known solutions described previously in the background, while at the same time reducing or eliminating the disadvantages associated with these conventional solutions. For this purpose, the scrolling functionality is performed both by the graphics accelerator and by the display refresh unit ("screen refresh unit"). The required bandwidth of the graphics accelerator can be drastically reduced with the aid of the present invention, and, moreover, an infinite scrolling range is possible without restriction by the width of the frame buffer.

With regard to the required bandwidth, it has proved to be particularly advantageous if the larger first image area is chosen to be 4 times as large as the second image area that can be presented on the display unit. For this purpose, the first image area can be chosen to be twice as wide and twice as high as the second image area that can be presented on the display unit.

Each memory section of the frame buffer may comprise, for example, 512×384 pixels (i.e., 512×384 bytes in the case of a 256 color representation). Furthermore, the larger first image area can be subdivided into a total of 16 image area sections, preferably four of these 16 image area sections being occupied by the second image area that can be presented and is visible on the display unit.

BRIEF DESCRIPTION OF THE DRAWINGS

The present disclosure is explained in more detail below using exemplary embodiments with reference to the drawings.

DETAILED DESCRIPTION OF THE PREFERRED EMBODIMENTS

Figure 1:
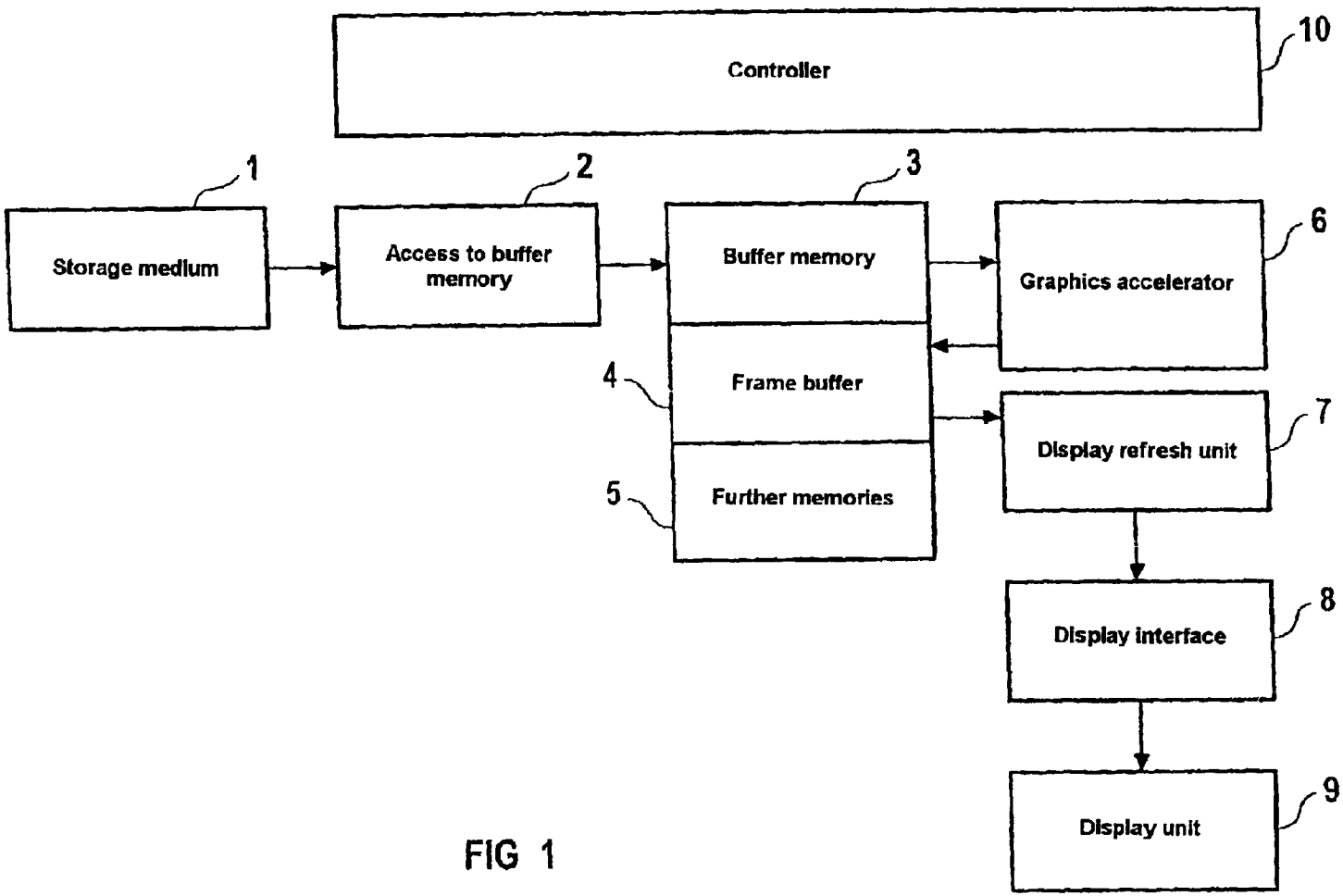
FIG. 1 shows a simplified block diagram of a device according to the teachings of invention for scrolling an image to be presented on a display unit.

As is shown in FIG. 1, the image data stored in a suitable storage medium 1, for example a CD-ROM, a hard disk, a server or the like, are loaded into a buffer memory 3 ("resource memory") via a suitable transmission link 2, which may be configured either without cables or in a cable-based manner. The image data stored in the buffer memory 3, whose capacity is relatively large with respect to a frame buffer 4 described in more detail below, form the basis for the image processing described in greater detail hereinafter.

A graphics accelerator 6 accesses the image data stored in the buffer memory 3 and moves them to the already mentioned frame buffer 4, which is addressed by a display refresh unit 7 ("screen refresh unit") in order to read the image data—stored in the frame buffer 4—of a specific image area and feed them via a display interface 8 to a display unit 9 (e.g., a screen) and to present the desired image area on the display unit 9. FIG. 1 additionally represents further memories 5, which are configured, for example, in the form of registers and may be provided in particular for storing pointers that will be explained in more detail below. The function of the device shown in FIG. 1 and also the coordination of the individual components is controlled by a controller 10 in the form of a software-based microcontroller, for example. The controller 10 and display refresh unit 7, working in conjunction, comprise a control system for the overall device shown in FIG. 1.

The image area that can be presented on the display unit 9 may amount to 1024×768 pixels, for example. By contrast, the memory area of the frame buffer 4 is dimensioned in such a way that it can always store the image data of an image area which is larger than the image area that can be presented on the display unit 9. In this case, it has proved to be particularly advantageous if the image area that can be stored in the frame buffer 4 is approximately four (4) times as large as the image area that can be presented on the display unit 9 and, for this purpose has dimensions (e.g., in the horizontal and vertical direction) that are twice as large as the image area that can be presented on the display unit 9.

Figure 2:
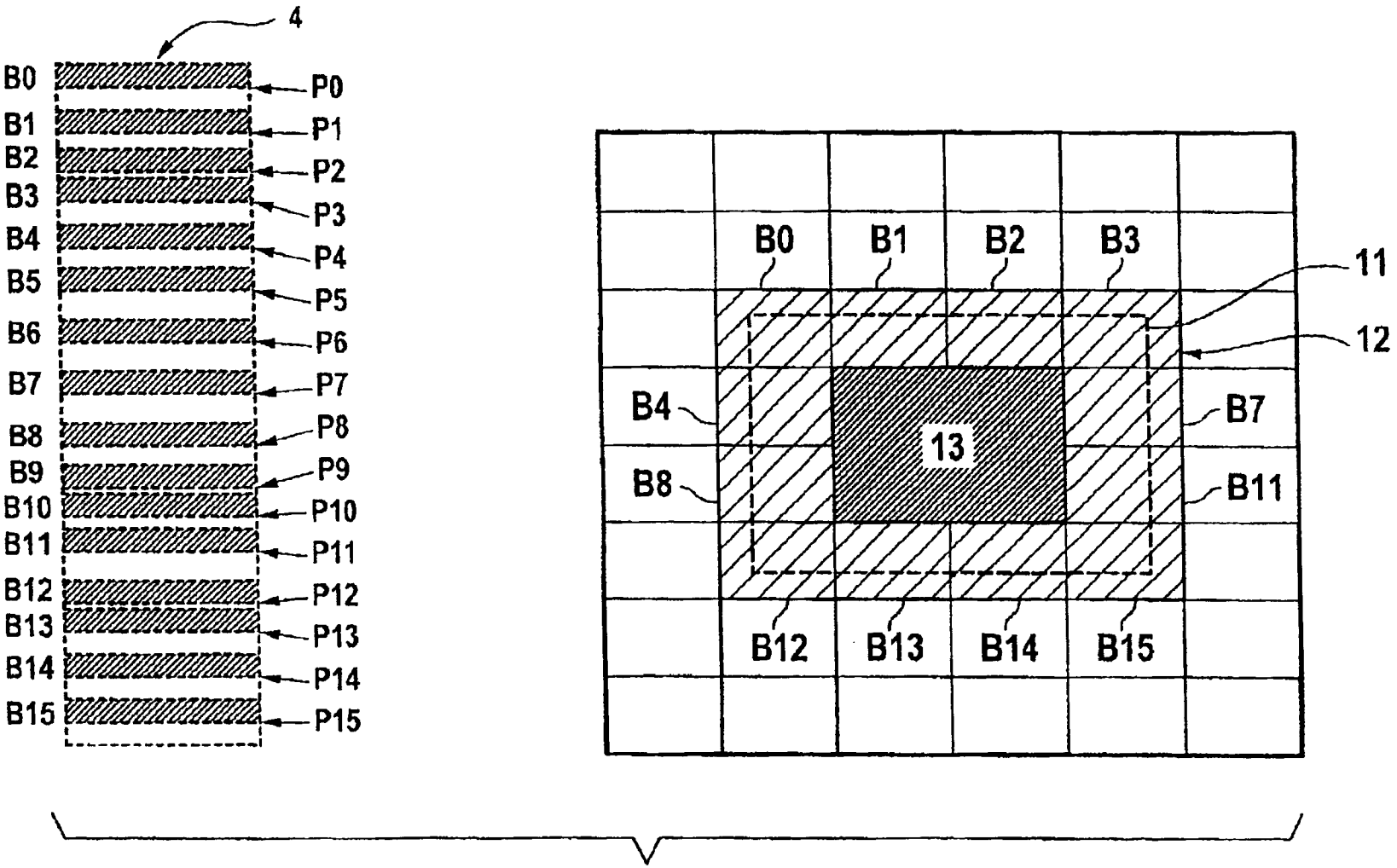
FIG. 2 shows a representation for illustrating an image area which is larger than the image area that can be presented on the display unit, and also for illustrating the subdivision of this larger image area into a plurality of image area sections and of the frame buffer shown in FIG. 1 into a plurality of memory sections.

A corresponding representation is shown in FIG. 2, where the image area that can be presented on the display unit 9 is designated by the reference symbol 13 and the image area that can be stored in the frame buffer 4 is designated by the reference symbol 12. As can be seen from FIG. 2, the image area 13 that can be presented on the display unit 9 lies within the image area 12 stored in the frame buffer 4, this image area 12 being shown hatched.

As can be seen from FIG. 2, the image area 12 stored in the frame buffer 4 is subdivided into a plurality of image area sections. In particular, the image area is subdivided into 16 image area sections in the exemplary embodiment illustrated. The frame buffer 4 correspondingly has 16 memory sections B0–B15 in which the image data for one of the image area sections of the image area 12 are respectively stored. Each of these memory sections B0–B15 is addressed by means of a pointer P0–P15, each pointer P0–P15 defining the assignment between the corresponding memory section B0–B15 and the corresponding image area section of the image area 12. In this case, each pointer P0–P15 preferably has a fixed designation of or assignment to an image area section with a specific position within the image area 12. Thus, by way of example, the pointer P0 always points to that memory section in which the image data of the top left image area section of the image area 12 are stored (e.g., memory section BO). Correspondingly, the pointer P15 always points to that memory section in which the image data of the bottom right image area section of the image area 12 are stored (e.g., memory section B15). Thus, in the initial situation shown in FIG. 2, there results the assignment—also illustrated in FIG. 2—of the memory sections B0–B15 ("sub-buffer") to the individual image area sections of the image area 12.

Figure 3:
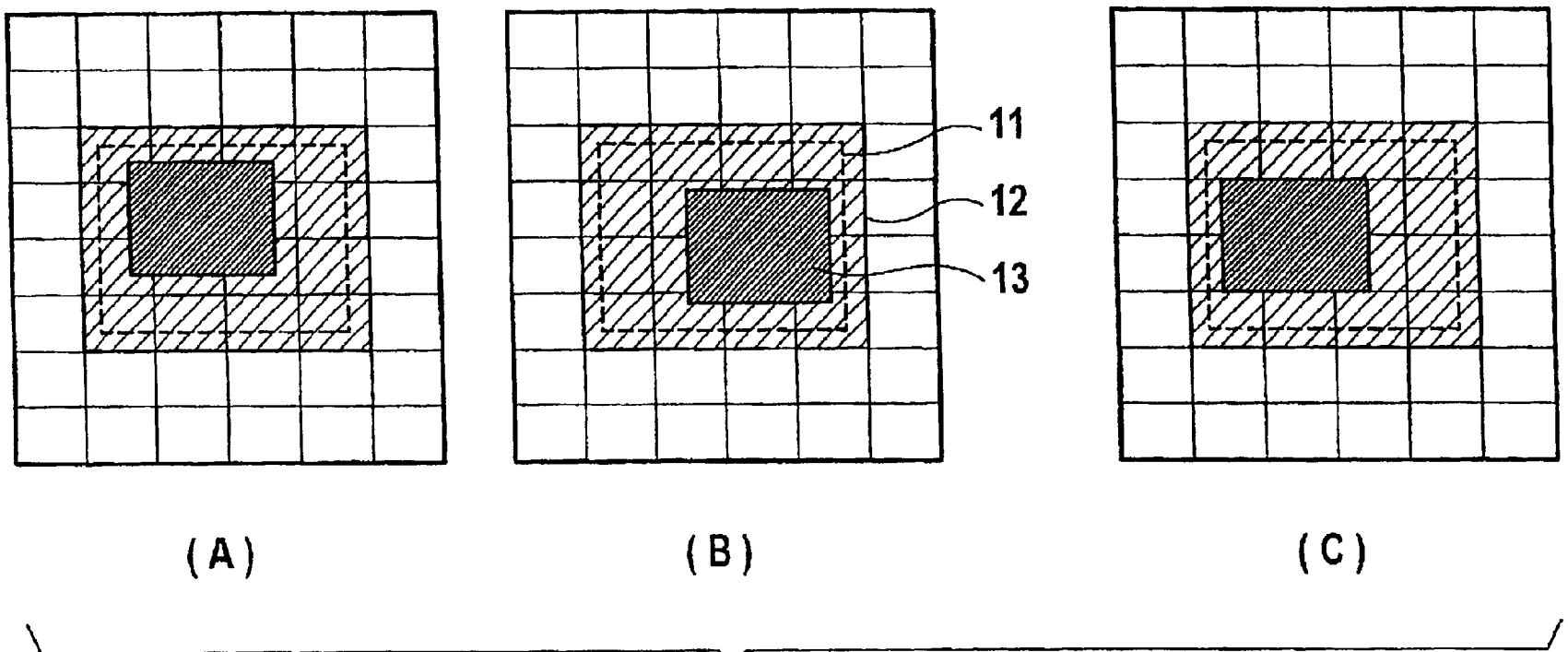
FIGS. 3A–3C show representations for illustrating the scrolling of the image area that can be presented on the display unit within a boundary defined in the surrounding larger image area.

The individual pointers P0–P15 are stored, for example, in a corresponding register of the memory section 5 shown in FIG. 1. Furthermore, there is stored in a register of the memory section 5 a pointer which defines the position of the visible image area 13 within the image area 12 in the horizontal direction (x-direction) and the vertical direction (y-direction), this pointer, for example, describing the position of the top left corner of the visible image area 13 within the image area 12 and specifying this position in the form of a specific pixel location. Consequently, the image area 13 that can be presented on the display unit 9 can be gently scrolled simply by modifying or changing the pointer, as is shown for example in the representations of FIGS. 3A–3C. In the examples illustrated, the visible image area 13 in each case comprises image data that correspond to four image area sections of the surrounding image area 12. In a manner dependent on the value of the pointer, which defines the position of the visible image area 13 within the image area 12, the display refresh unit 7 shown in FIG. 1 reads the image data corresponding to the image area 13 from the frame buffer 4 or the individual memory sections B0–B15, with the result that the image data can subsequently be presented on the display unit 9.

As is shown in FIG. 2 and FIGS. 3A–3C, a boundary 11 is defined within the image area 12. The instantaneous position of the image area 13 that can be presented on the display unit 9 is continuously monitored by the controller 10 with respect to the boundary 11. As soon as it is ascertained that the image area 13 that can be presented on the display unit 9 abuts the boundary 11 on account of a scrolling operation, then, in the manner described below, the pointers P0–P15 are defined anew and specific image area sections or the corresponding memory sections of the frame buffer 4 are occupied by new image data from the storage medium 1 or the buffer memory 3, with the result that the image area 12 encompassing the image area 13 that can be presented on the display unit 9 is extended in the scrolling direction of the image area 13. This will be explained in more detail below with reference to the representations of FIG. 4A and FIG. 4B.

Figure 4A:
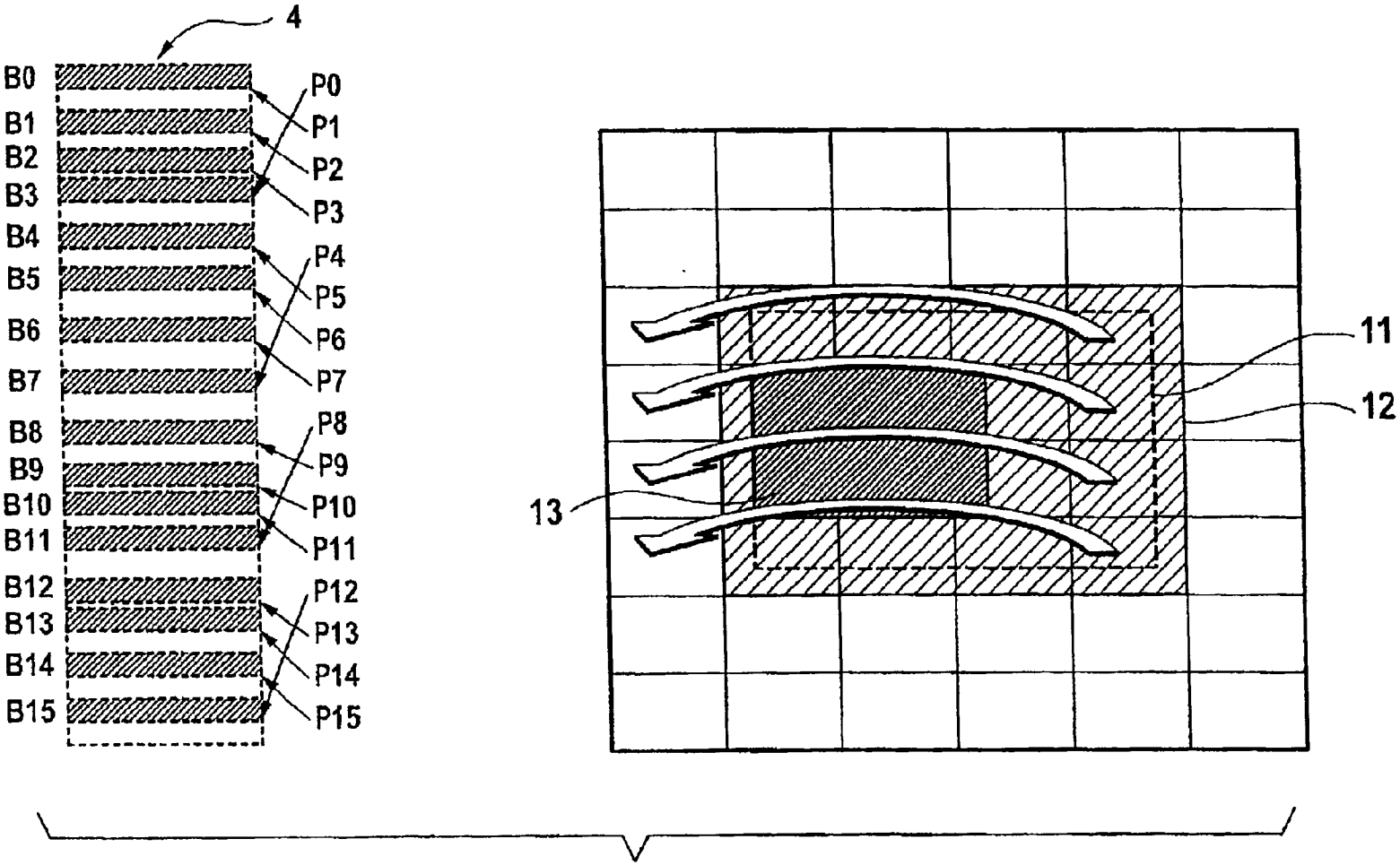
FIGS. 4A and 4B show representations for illustrating changing of pointers which define the relationship between the individual image area sections of the larger image area and the individual memory sections of the frame buffer, and also the effect of this pointer change.

In accordance with FIG. 4A, it is assumed that the visible image area 13 has been scrolled towards the left in the horizontal direction and thereupon reaches the boundary 11. Those memory sections that are assigned to the image area sections which are the furthest away from the point of collision with the boundary 11 in the opposite direction to the scrolling direction are loaded with new image data from the buffer memory 3 or the storage medium 1, these memory sections receiving for storage, in particular, image data that supplement or extend the image area 12 in the scrolling direction of the visible image area 13. In the case of the example shown in FIG. 4A, this means that the four memory sections B3, B7, B11 and B15 which were originally assigned to the right-hand column of the image area 12 (see FIG. 2) are loaded with new image data in such a way that the image data newly loaded into these memory sections extend the image area 12 towards the left.

Figure 4B:
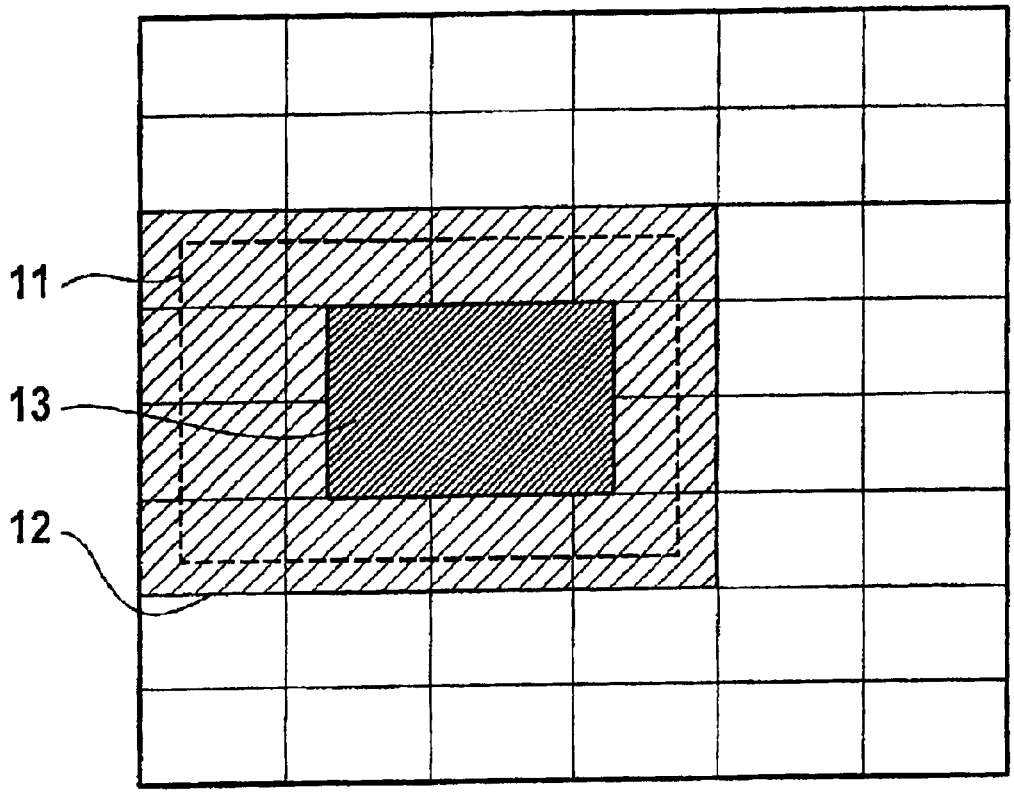

Afterwards, the pointers P0–P15 are modified in such a way that the new definition or scrolling of the image area 12 is actually realized. For this purpose, the pointers P0–P15 must be modified, in particular, in such a way that subsequently, as shown in FIG. 4A, the image area sections of the right-hand column of the image area, 12 which are occupied by new image data, are scrolled in the direction of the arrow and, finally, form the left-hand column of the image area 12 that is thus newly defined. FIG. 4A shows how the pointers P0–P15 have to be defined anew in order to obtain the new image area 12 desired, which is shown in FIG. 4B (it should be noted that, by way of example, the pointer P0 always points to that memory section of the frame buffer 4 in which the image data of the top left image area section of the image area 12 are stored, etc).

After the new definition of the image area 12, the pointer, which defines the x- and y-position of the visible image area 13 within the image area 12, also has to be correspondingly changed or adapted by the controller 10 in the memory 5.

Overall, it must be emphasized that when the boundary 11 is reached on account of scrolling of the image area 13, the image area 12 is positioned anew, in the manner described above, around the image area 13 visible on the display unit 9 by the pointers P0–P15 being optimally adapted to the position of the image area 13 visible on the display unit 9. It will be apparent to those skilled in the art that the method described above can be carried out analogously for the case where the image area 13 visible on the display unit 9 is scrolled in the vertical direction, for example, and, accordingly, abuts the upper or lower edge of the boundary 11. Equally, it is conceivable, in principle, for a similar method to be carried out when the image area 13 is scrolled in the diagonal direction, so that a corner of the image area 13 abuts a corner of the boundary 11. In this case, it is expedient for the image area 12 to be newly positioned around the image area 13 in such a way that the image area 12 is changed both horizontally and vertically in accordance with the scrolling direction.

Figure 5:
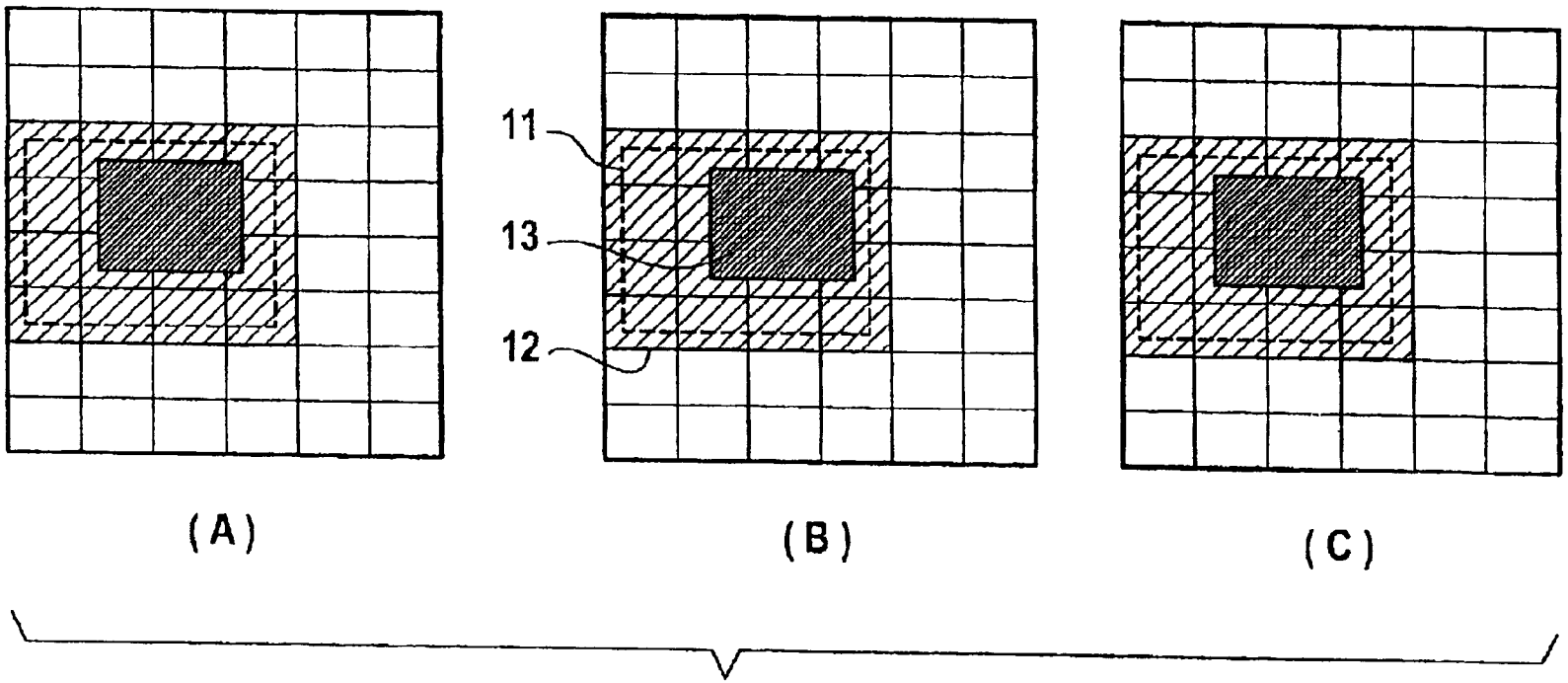
FIGS. 5A–5C show representations for illustrating the scrolling of the image area that can be presented on the display unit within the larger image area that is newly defined in accordance with FIG. 4B.

After an above-described new definition of the image area 12, the image area 13 visible on the display unit 9 can again be scrolled within the boundary 11, which has correspondingly likewise been newly defined by the controller 10, simply by changing the pointer that defines the position of the visible image area 13 within the image area 12, as is shown by way of example in FIGS. 5A-5C. As soon as the newly positioned boundary 11 is reached again on account of scrolling of the image area 13 that is visible on the display unit 9, the above-described method for correspondingly adapting the image area 12 is to be carried out again.

The text below will specify how the procedure according to the invention affects the bandwidth required for the graphics accelerator 6. In this case, it is again assumed that the visible area of the display unit 9 amounts to 1024×768 pixels and the system works with a color depth of 256 colors (i.e., 1 byte per pixel).

The visible area 13 is to be scrolled for example at a scrolling rate of 1024 pixels per second in the horizontal direction (i.e., four memory sections of the frame buffer 4 per second have to be loaded with new image data). Each memory section B0–B15 is configured in such a way that it can store the image data of 512×384 pixels. These conditions thus correspond to the conditions used in the calculation of the bandwidth for the prior art described previously. Thus, when using the method according to the teachings of the invention, the following results for the bandwidth of the graphics accelerator 6:

$$512\times384[\text{pixels/memory section}]\times4[\text{memory sections}]\times1[\text{byte/pixel}]\times2\ [1/\text{s}]=1.573\ \text{MB/s} \quad (2)$$

This corresponds to approximately 1/25 to approximately 1/60 of the bandwidth required in accordance with the prior art described in the introduction (see formula (1) described previously).

Formula (2) above corresponds to an estimation of the bandwidth required on average for the graphics accelerator 6. Depending on the specific conditions, however, a larger bandwidth may also be required for the graphics accelerator 6, which depends in particular on the width of the boundary 11 and the scrolling rate. The scrolling rate has already been defined as 1024 pixels/s. If it is assumed, for example, that the boundary 11 comprises a width of 340 pixels, this results in a minimum memory transfer time for the corresponding four memory sections of 340/1024 s=332 ms. In this case, the following results for the required bandwidth of the graphics accelerator 6:

$$512\times384[\text{pixels/memory section}]\times4[\text{memory sections}]\times1[\text{byte/pixel}]\times1/0.332[1/\text{s}]=2.369\ \text{MB/s} \quad (3)$$

This still corresponds to approximately 1/16 to approximately 1/39 of the average bandwidth required in the case of the prior art described in the introduction (see formula number (1)). If the width of the boundary 11 is widened to 400 pixels, the maximum required bandwidth of the graphics accelerator 6 would decrease to 0.00201 GB/s, which corresponds to approximately 1/9 to approximately 1/46 of the bandwidth required in accordance with the prior art.

It should be noted that the forementioned maximum bandwidth of the graphics accelerator 6 cannot simply be reduced as desired by correspondingly increasing the width of the boundary 11. The width of the boundary 11 serves as a certain hysteresis in order, during the scrolling of the visible image area 13, to avoid unnecessary memory transfers during lengthy changing of the scrolling direction. If the scrolling direction is changed only when the visible image area 13 has just reached the boundary 11 at a specific location, this constitutes a "worst case" scenario for the bandwidth of the accelerator 6. The bandwidth required in this case increases drastically if the width of the boundary 11 is chosen to be too large. Upon application of the present invention, the bandwidth required in this "worst case" scenario can be halved compared with the first solution in accordance with the prior art as described in the introduction, if the width of the boundary is set to its maximum value.

The above-described device and also the above-described method can be parameterized in order, by means of corresponding calculations, to obtain the optimum configuration for the respective application with regard to the number of image area sections (and thus also the number of memory sections), the position of the boundary 11 within the image area 12 or the width of the boundary 11, etc.

Figure 6:
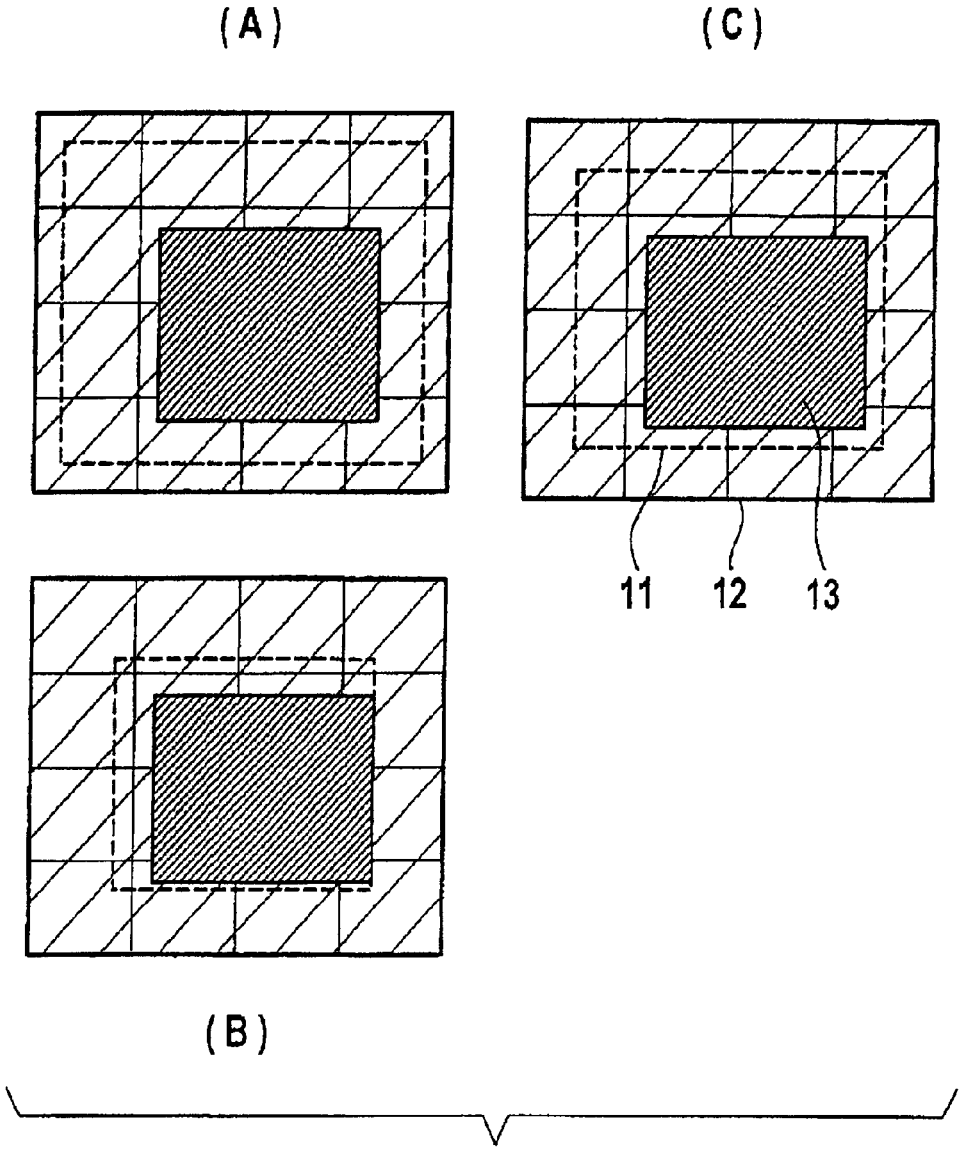
FIGS. 6A–6B, FIG. 7A, FIG. 7B, FIG. 8A and FIG. 8B show representations of variations of methods and apparatuses constructed according to the teachings of the present invention.
Figure 7:
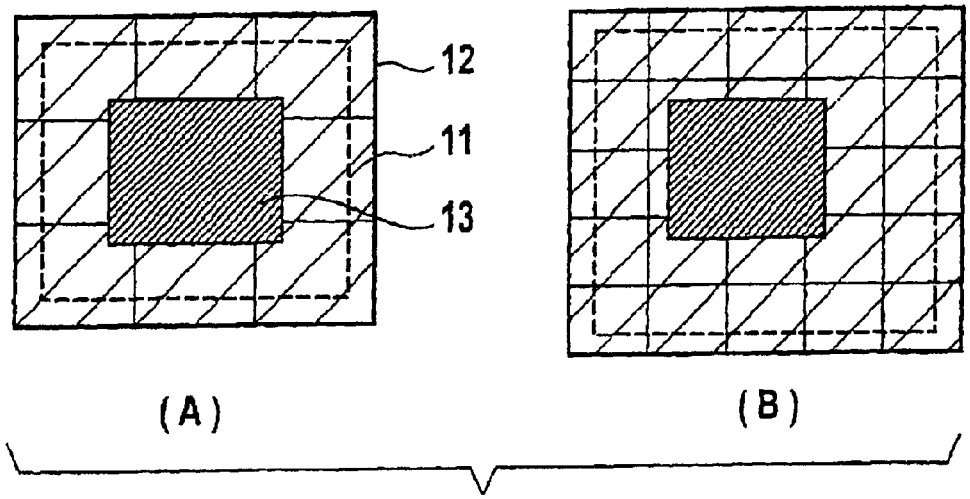
Figure 8:
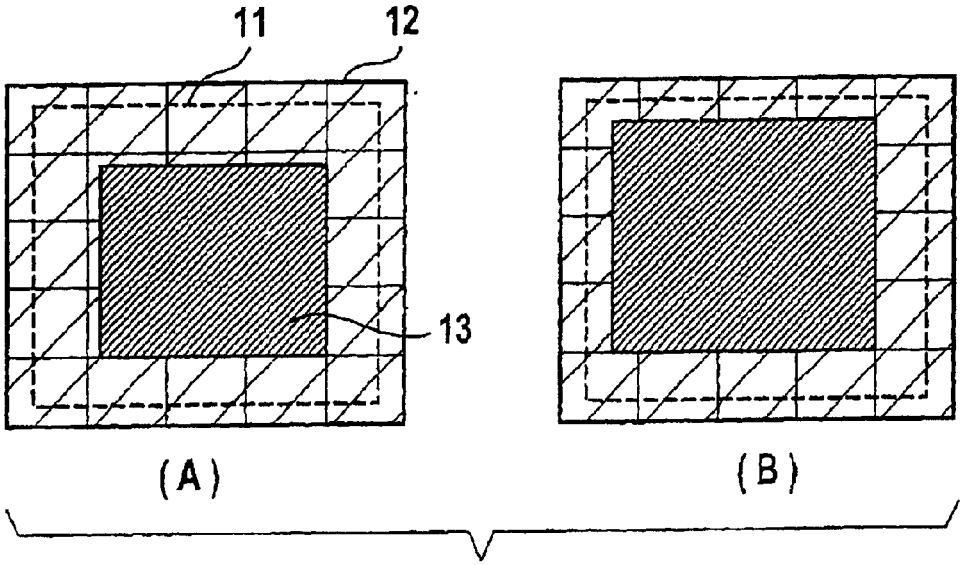

FIGS. 6A–6C illustrate various examples for different positions of the boundary 11 within the image area 12. Furthermore, FIG. 7A and FIG. 7B illustrate examples for a different number of image area sections of the image area 12. Finally, FIG. 8A and FIG. 8B illustrate examples for different capacities of the frame buffer 4 with regard to the image area 13 that can be presented and is visible on the display unit 9.

In conclusion, the disclosed method and apparatus constructed in accordance with the teachings of the invention provide definition of a first image area that is larger than the image area that can be presented on the display unit and is designated as the second image area. The image data corresponding to this first image area are stored in the frame buffer. The position of the second image area within this first image area is defined by first address information items, which are realized in particular in the form of a pointer. The frame buffer is addressed in a manner dependent on these first address information items in order to read corresponding image data from the frame buffer and present them in the form of the second image area on the display unit. The scrolling of the image or of the second image area presented on the display unit can be carried out simply by changing the first address information items.

Also, according to the teachings of the invention, the first image area, which contains the second image area that can be presented on the display unit, is subdivided into a plurality of image area sections, the image data of a corresponding memory section of the frame buffer being assigned to each image area section. Each of these memory sections can also be referred to as "sub-buffer". Second address information items, which, described above, are preferably realized in the form of pointers, establish, on the one hand, the relationship between the individual image area sections and the individual memory sections and, on the other hand, define where the image data of the individual memory sections are positioned within the first image area. Thus, a specific pointer, for example, always designates that memory section whose image data are arranged in the top left corner of the first image area, etc.

Further, according to the teachings of the invention, a boundary is defined for the position of the second image area, which can be presented on the display unit, within the larger first image area, the position of the second image area within the first image area being continuously monitored with respect to the said boundary. If it is ascertained with the aid of a corresponding control software, for example, that the said predetermined boundary is reached at a specific boundary location on account of scrolling of the second image area, those memory sections of the frame buffer which are assigned to the image area sections of the first image area which are the furthest away from the said boundary location in the opposite direction to the scrolling direction are loaded with new image data from a corresponding storage medium, for example a CD-ROM, a hard disk or a server, etc., and the second address information items are changed in such a way that the first image area is extended in the scrolling direction of the second image area by the image area sections which are the furthest away from the specific boundary location in the opposite direction to the scrolling direction and for which new image data have been loaded into the corresponding memory sections. Afterwards, the second image area that can be presented on the display unit can again be scrolled in a conventional manner simply by changing the pointer, or the corresponding first address information items, defining the position of the second image area within the larger first image area.

The foregoing description has been presented for the purposes of illustration and description. It is not intended to be exhaustive or to limit the teaching of the invention to the exemplary embodiments disclosed. Many modifications and variations are possible in light of the above teachings and it is intended that the scope of the invention be limited not by this detailed description, but rather by the claims appended hereto.

What is claimed is:

1. A method for scrolling an image to be presented on a display unit comprising the steps of:

storing image data of a first image area in a frame buffer, wherein the first image area is larger than a second image area that can be presented on the display unit and contains the second image area;

addressing the frame buffer in a manner dependent on first address information items that define the position of the second image area within the first image area, and reading corresponding image data from the frame buffer and presenting the corresponding image data on the display unit in the form of the second image area;

changing the first address information items in order to scroll the second image area presented on the display unit;

subdividing the first image area into a plurality of image area sections and assigning the image data of a corresponding memory section of the frame buffer to each image area section through the use of corresponding second address information items, the second address information items each having a fixed assignment to a corresponding image area section within the first image area;

defining a boundary for the position of the second image area within the first image area by utilizing the first address information items;

monitoring the position of the second image area within the first image area with respect to the boundary; and loading new image data into specific memory sections of the frame buffer that are assigned to the image area sections of the first image area that are the furthest away from a specific boundary location in a direction opposite to a scrolling direction when the boundary is reached at the specific boundary location on account of scrolling of the second image area, and correspondingly changing the second address information items in such a way that the first image area is extended in the scrolling direction by the image area sections which are the furthest away from the specific boundary location in the direction opposite to the scrolling direction and for which new image data have been loaded into the specific memory sections.

2. The method according to claim 1, wherein the first address information items and the second address information items are configured in the form of pointers.

3. The method according to claim 1, wherein after the new image data is loaded into the specific memory sections, the second address information items are changed and the first image area, the boundary and the first address information items defining the position of the second image area within the first image area are correspondingly changed.

4. The method according to claim 1, wherein one or more of the first image area, the second image area, the boundary and the individual image area sections of the first image area are defined in rectangular form.

5. The method according to claim 1, wherein for the case when the boundary is reached at a specific boundary location on account of scrolling of the second image area, only those memory sections of the frame buffer are loaded with the new image data which are assigned to the image area sections of the first image area which are the furthest away from the said specific boundary location in the opposite direction to the scrolling direction.

6. The method according to claim 1, wherein the first image area is subdivided into 16 image area sections.

7. The method according to claim 1, wherein the first image area is set to be four times as large as the second image area that can be presented on the display unit.

8. The method according to claim 7, wherein the width and the height of the first image area are both set to be twice as large as the respective width and height of the second image area that can be presented on the display unit.

9. The method according to claim 1, wherein each memory section of the frame buffer is configured for storing the image data of an image area section having 512×384 pixels.

10. An apparatus for scrolling an image to be presented on a display unit, comprising:

a frame buffer configured for storing image data of a first image area, wherein the first image area is larger than a second image area that can be presented on the display unit and contains the second image area;

a memory configured for storing first address information items, which define the position of the second image area within the first image area; and a control system configured for addressing the frame buffer in a manner dependent on the first address information items and for reading corresponding image data from the frame buffer in order to present the image data on the display unit in the form of the second image area, wherein the second image area to be presented on the display unit can be scrolled by changing the first address information items;

wherein the first image area is subdivided into a plurality of image area sections and the image data of a corresponding memory section of the frame buffer are assigned to each image area section through the use of corresponding second address information items, which are stored in the memory and each having a fixed assignment to a corresponding image area section within the first image area, and a boundary is defined for the position of the second image area within the first image area by utilizing the first address information items; and wherein the control system is further configured to monitor the position of the second image area within the first image area with respect to the boundary and, in a case when the boundary is reached at a specific boundary location on account of scrolling of the second image area, the control system causes memory sections of the frame buffer, which are assigned to the image area sections of the first image area that are the furthest away from the specific boundary location in a direction opposite to a scrolling direction, to be loaded with new image data and change the second address information items stored in the memory such that the first image area is extended in the scrolling direction by the image area sections that are the furthest away from the specific boundary location in the opposite direction to the scrolling direction and for which new image data have been loaded into the corresponding memory sections of the frame buffer.

11. The apparatus according to claim 10, wherein the first address information items and the second address information items are configured in the form of pointers.

12. The apparatus according to claim 10, wherein the control system is configured in such a way that after the loading of new image data into the specific memory sections, the second address information items are changed and the first image area, the boundary and the first address information items defining the position of the second image area within the first image area are correspondingly changed.

13. The apparatus according to 10, one or more of the first image area, the second image area, the boundary and the individual image area sections of the first image area are defined in rectangular form.

14. The apparatus according to claim 10, wherein the control system is configured in such a way that, in the case when the boundary is reached at a specific boundary location on account of scrolling of the second image area, only those memory sections of the frame buffer that are assigned to the image area sections of the first image area furthest away from the specific boundary location in the opposite direction to the scrolling direction are loaded with the new image data.

15. The apparatus according to claim 10, wherein the first image area is subdivided into 16 image area sections.

16. The apparatus according to claim 10, the first image area is set to be four times as large as the second image area that can be presented on the display unit.

17. The apparatus according to claim 16, wherein the width and the height of the first image area are set to be twice as large as the respective width and height of the second image area that can be presented on the display unit.

18. The apparatus according to claim 10, wherein each memory section of the frame buffer is configured for storing the image data of an image area section having 512×384 pixels.

* * * * *

UNITED STATES PATENT AND TRADEMARK OFFICE

CERTIFICATE OF CORRECTION

PATENT NO. : 7,050,073 B2
APPLICATION NO. : 10/003552
DATED : May 23, 2006
INVENTOR(S) : Michael Abler It is certified that error appears in the above-identified patent and that said Letters Patent is hereby corrected as shown below:

In the claims:

Column 11, line 22, before “one” add -- wherein --.

Signed and Sealed this

Twenty-seventh Day of March, 2007

JON W. DUDAS
*Director of the United States Patent and Trademark Office*